United States Patent [19]

Baumgart

[11] Patent Number: 4,673,230

[45] Date of Patent: Jun. 16, 1987

[54] SECURITY DEVICE FOR ELECTRICAL PLUG

[76] Inventor: Herbert P. Baumgart, 1604 N. 9th Ave., Melrose Park, Ill. 60160

[21] Appl. No.: 845,186

[22] Filed: Mar. 28, 1986

[51] Int. Cl.[4] ..... H01R 13/44

[52] U.S. Cl. ..... 439/133; 439/135; 439/304

[58] Field of Search ..... 339/36, 37, 82

[56] References Cited

U.S. PATENT DOCUMENTS

| | | | |
|---|---|---|---|
| 2,654,073 | 9/1953 | Katz | 339/37 |
| 2,844,805 | 7/1958 | Darrell | 339/37 |
| 4,488,764 | 12/1984 | Pfenning et al. | 339/82 |
| 4,592,607 | 6/1986 | Pejovic | 339/37 |

FOREIGN PATENT DOCUMENTS

| | | | |
|---|---|---|---|
| 2117818 | 10/1972 | Fed. Rep. of Germany | 339/37 |
| 1354173 | 1/1964 | France | 339/37 |

*Primary Examiner*—Gil Weidenfeld
*Assistant Examiner*—Paula A. Austin
*Attorney, Agent, or Firm*—Wood, Dalton, Phillips, Mason & Rowe

[57] ABSTRACT

An apparatus is provided for preventing the unauthorized use of an electrical device such as a power tool or television set. The apparatus has the further provision of being retained on an electrical cable associated with the electrical device. The apparatus has an enclosure having a bottom and a peripherally extending side wall with an open top portion affording an inner chamber. An aperture is included in the bottom of the enclosure for slidably receiving the cable with the cable extending longitudinally through the enclosure and thereafter the aperture such that the enclosure is retained on the cable between the plug and the electrical device. Spaced pairs of apertures are located at the top portion on opposite sides of the enclosure. The apparatus is slidably moved along the cable until the electrical plug is inserted into the chamber with the shackle of the lock then being inserted through the spaced pairs of apertures so as to limit the size of opening of the top portion of the enclosure when in the locked position to capture the electrical plug within the enclosure, thereby preventing unauthorized use.

6 Claims, 5 Drawing Figures

SECURITY DEVICE FOR ELECTRICAL PLUG

FIELD OF THE INVENTION

This invention relates generally to a security device for electrically powered apparatus, and more particularly, to a device for preventing unauthorized use of such apparatus by rendering the electrical plug inaccessible.

BACKGROUND OF THE INVENTION

For personal and/or safety reasons it is often desirable to prohibit the use of certain electrically operated devices. For example, when parents desire to prevent their children from watching certain television programs, it may be necessary to prevent the television set from being operated. Similarly, with potentially dangerous power tools, such as a table saw, it is desirable to prevent children or an unauthorized individual from using such a tool. The simplest way to achieve either of these goals is to unplug the device from its associated electrical outlet, and thereafter preclude the unauthorized user from reinserting the electrical plug into an outlet.

Additionally, it is desirable that any means utilized to preclude use of the electrical device be permanently retained by the electrical device to allow ease of use as well as minimizing any possibility of misplacement.

It is therefore desirable to have available a security device to prevent the unauthorized use of electrically powered devices which is permanently retained by the electrical device.

Prior art plug locking mechanisms have generally been restricted to use with certain types of plugs, or alternatively have been constructed in a complicated and costly manner. For example, U.S. Pat. Nos. 2,654,073 and 2,844,805 disclose devices which are limited in their usage to plugs having a predetermined number of prongs and/or a set arrangement therebetween. However, as electrical plug styles change according to voltage and/or grounding requirements, or where a plug is designed to be used in foreign countries, such devices cannot be utilized. It is therefore beneficial to have a universal plug securing device which can be used with any type of electrical plug.

U.S. Pat. No. 4,488,764 discloses an electrical plug locking apparatus which will preclude access to an electrical plug, without regard to the type of plug being used while also retaining the apparatus when same is not in use. This apparatus, however, requires the use of a multitude of custom-made parts which can result in increased production costs. For an original equipment manufacturer these costs may be prohibitive, rendering such a device impractical.

U.S patent application Ser. No. 756,507, owned by the inventor of the present application, discloses an electrical plug locking apparatus which captures an electrical plug within an enclosure. The enclosure has securing means in the form of slits in the enclosure through which an electrical cord is received for retaining the electrical cord and the enclosure in assembled relation. However, these securing means might be subject to breakage after continual usage depending on the materials used in constructing the enclosure.

With the deficiencies noted with regard to the prior art devices, it would be advantageous to provide an apparatus permanently secured to an electrical cable for preventing the unauthorized use of electrical devices that is designed using relatively few parts, thereby being simple and inexpensive to produce, while also being durable and easy to use.

The present invention is directed to overcoming one or more of the problems as set forth above.

SUMMARY OF THE INVENTION

The principal object of the present invention is to provide an apparatus for preventing the unauthorized use of an electrical device, the apparatus including an enclosure have an opening at one end through which an electrical plug can be inserted and a smaller opening at another end through which a conduit attached to the electrical plug can be inserted. The enclosure has apertures located on opposite sides at the opening of the enclosure. Also provided is a removable lock having a shackle, the shackle being sized to pass through the aperture thereby capturing the electrical plug within the enclosure when the plug is received in the enclosure and the shackle is in a locked position.

Another object of the present invention is to provide an apparatus for preventing the unauthorized use of an electrical device, the apparatus including an enclosure having a bottom and a peripherally extending side wall affording an inner chamber. The enclosure is open at its top portion so that an electrical plug can be inserted for positioning in the chamber. An aperture is included in the bottom portion of the enclosure for slidably receiving a conduit secured to the electrical device and the plug. The aperture is smaller in size than both the electrical plug and the electrical device, with the conduit extending longitudinally through the aperture and enclosure such that the enclosure is retained on the conduit. A removable lock is provided with a shackle which may be selectably movable between a locked and an unlocked position. The shackle is of a size to pass through each of said apertures to restrict the size of said open top portion and to capture the electrical plug within the enclosure when the shackle is moved to the locked position.

A further object of the present invention is to provide an apparatus for preventing the unauthorized use of an electrical device wherein the enclosure used to capture the electrical plug is formed of a flexible material.

DESCRIPTION OF THE PREFERRED EMBODIMENTS

Figure 1:
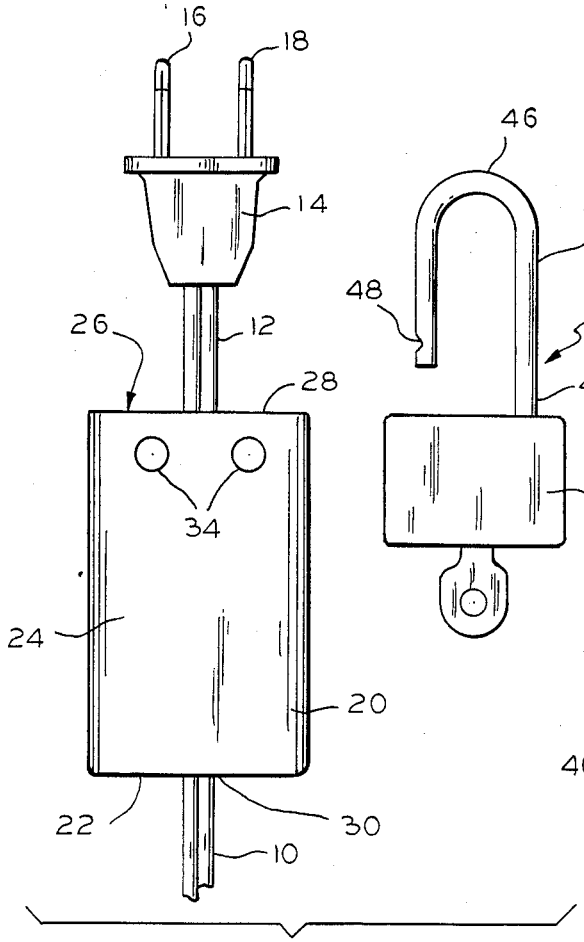
FIG. 1 is an elevational view of the apparatus of the present invention with the shackle of the lock in unlocked position.

Referring to FIG. 1, there is shown a preferred embodiment of the prevent invention. The present invention is used generally to prevent the unauthorized use of an electrically powered device such as a television set, hair dryer or saw, while being permanently retained by the device. Although no such electrically powered device is shown, the device would typically have an electrical conduit or cable 10 attached thereto to enable the electrically powered device to be attached to a source of power.

The cable 10 at its remote end 12 is secured by any known means to an electrical plug 14. The electrical plug 14 as shown has two prongs 16 and 18 to be inserted into an outlet, not shown, for powering the device. While a two prong plug 14 and a two conductor cable 10 are shown, this invention could also be utilized in conjunction with any other known plug and cable arrangement.

An enclosure 20 is provided having a closed bottom portion 22 and a peripherally extending side wall 24 forming an inner chamber 26. The enclosure 20 is open at its top portion 28 so that the electrical plug 14 can be readily positioned in, or removed from, the inner chamber 26 of the enclosure 20.

The enclosure 20 is provided with an aperture 30 located in the bottom portion 22. The aperture 30 is of a size larger than the cable 10 but smaller than the plug 14 and the electrical device. The aperture 30 slidably receives the cable 10 with the cable 10 extending longitudinally through the aperture 30 and enclosure 22. As can be seen, the enclosure 20 is retained on the cable 10 at some position between the remote end 12 and the device end (not shown) of the cable 10.

Figure 4:
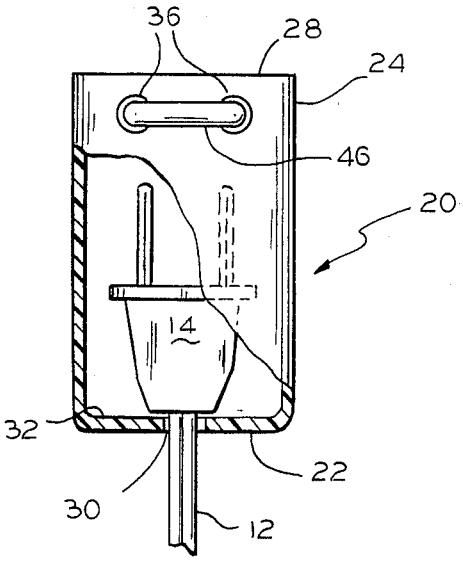
FIG. 4 is a partially cut away elevational view of the present invention with the shackle of the lock in locked position.

Said retention is due to the fact that while the enclosure 20 may be slidably positioned anywhere along the cable 10 the enclosure 20 will have a first limited position at a point where the plug 14 abuts an inner side 32 of the bottom portion 22, as is best illustrated with reference to FIG. 4. A second limited position is at a point where the enclosure 20 is positioned along the cable 10 so that the bottom portion 22 abuts the electrical device (not shown). Therefore, as long as the cable 10 is secured to the plug 14 and the electrical device, the enclosure cannot be removed therefrom.

In normal usage it is expected that the plug locking apparatus of the present invention would be assembled to the electrical device at the time of manufacturing and then be sold as part of the electrical device.

At the top portion 28 of the enclosure 20 spaced pairs of apertures 34 and 36 are located on opposite sides of the side wall 24. Each pair 34 and 36 is provided with equal spacing between the individual apertures in its respective pair 34 and 36. Similarly, each pair 34 and 36 is located directly opposite such that each aperture in one pair 34 and 36 lines up with an associated aperture of the alternate pair 34 and 36.

A lock 38 is provided with a shackle 40. The shackle is selectively movable between a locked and an unlocked position. One end 42 of the shackle 40 is rotatably and slidably attached internally to a lock box 44. The shackle also has a U-shaped portion 46 and a notched end portion 48. In the unlocked position as shown in FIG. 1, the end portion 48 of the shackle is removed from the lock box 44 such that the inner end 42 may pivot where it enters the lock box 44.

To apply the plug locking mechanism, the plug 14 and attached portion of cable 12 are inserted in the inner chamber 26 of the enclosure 20 by slidably moving the enclosure 20 along the cable 10 until the plug 14 is positioned fully within the enclosure 20. The shackle 40 of the lock 38 is then inserted through one of the apertures in the pair 34 and 36 through the associated aperture of the opposite pair 34 and 36 and then inserted back through the two remaining apertures. The shackle 40 will then be pivoted to line up the notched end 48 and the lock will be slidably moved to its locked position with the notched end 48 then being internal to the lock box 44.

Figure 2:
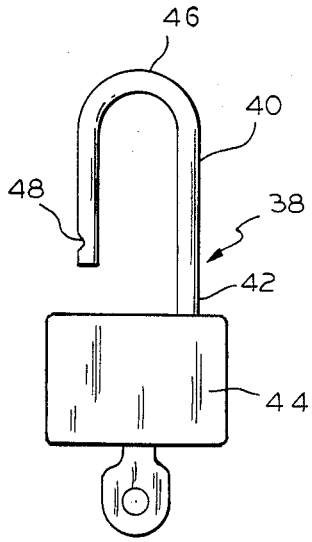
FIG. 2 is a plan view of the present invention with the shackle of the lock in locked position capturing the electrical plug within the enclosure.
Figure 2:
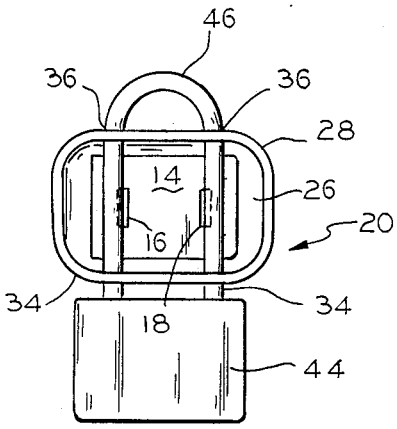
Figure 3:
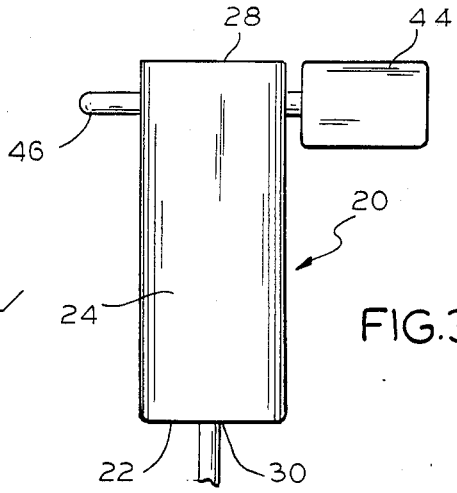
FIG. 3 is a side view of the apparatus as shown in FIG. 2.

Referring now to FIGS. 2 and 3 there is shown various views of the preferred embodiment of the present invention in which the plug 14 has been placed in the locked position in the inner chamber 26 of the enclosure 20. As can be seen by positioning the plug within the enclosure 22 and then inserting the shackle 40 through said apertures 34 and 36, the plug 14 is prevented from being removed from the enclosure 20 due to the obstruction caused by the positioning of the shackle 40 which limits in size the available opening of the top portion 28 of the enclosure 20. In so doing the electrical plug 14 will be captured within the enclosure 20 and cannot be removed without disengaging the lock 38. Therefore, access to the plug is limited to one having the ability to disengage or unlock the lock 38 so that the plug 14 can be removed, thereby preventing unauthorized use of the associated electrical device.

The lock shown is a key actuated lock, however, the invention would work equally well with a combination type lock or any known lock having a shackle or chain wherein the shackle or chains are of such size so that it can pass through the apertures 34 and 36 and limit the available opening sufficiently to prevent the plug 14 from being removed from the enclosure 20.

The security device of the present invention is adapted for use by original equipment manufacturers as a permanent attachment and part of their manufactured electrically powered devices. However, the device is also structured and adapted for sale through consumer channels of trade so that consumers may individually use the devices on electrically powered apparatus which the consumer has previously purchased.

In a sale through consumer channels, the consumer simply needs to detach the electrical cable either from its associated plug or the electrical device itself, and thereafter insert the cable through the aperture in the bottom portion of the enclosure so that the enclosure may be slidably positioned along the cable. Subsequently, the cable must be re-attached to the plug and device.

Figure 5:
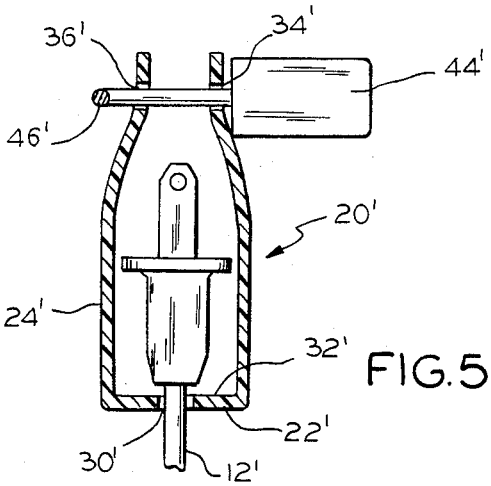
FIG. 5 is a cross sectional view of the present invention utilizing a flexible enclosure with the shackle of the lock in locked position.

The enclosure while shown being rounded at its edges may also be provided with squared off corners according to the particular material being used for the enclosure. In the preferred embodiment the enclosure is manufactured using any one of a number of prior art materials and preferably is of one piece construction. Specifically, the embodiment shown in FIG. 5 includes an enclosure 20' manufactured of a flexible material such as durable plastic, fabric or even metal mesh.

With a flexible enclosure 20', a lock 38' having a relatively short shackle 40' may be utilized with the shackle 40' and lock box 44' causing the top portion 28' of the enclosure 20' to be compressed, further limiting the available opening at the top portion of the enclosure and further restricting the ability of the plug 14 to be removed from the enclosure to thereby prevent unauthorized use of the associated electrical device.

In yet another embodiment, the enclosure 20 may be provided with dual apertures each being located on opposite sides of the top portion of the enclosure. In this embodiment only one portion of a shackle would be utilized in providing an obstruction in the opening to the enclosure 20 to thereby limit the available opening when in locked position. In this instance different types of locks could be used which would not necessarily be U-shaped in nature.

As has been illustrated above, the present invention provides an apparatus designed using basically two parts, an enclosure 20 and a lock 38, to provide a reliable and inexpensive device for preventing the unauthorized use of electrically powered devices, while also being retained on the cable 10 associated with the electrically powered device.

The foregoing description is given for clearness of understanding only and no unnecessary limitations should be implied therefrom, as modifications will be obvious to those skilled in the art.

I claim:

1. An apparatus for preventing the unauthorized use of an electrical device, the electrical device including an electrical conduit attached at one end to the electrical device, and its other end to an electrical plug, the apparatus comprising:

an enclosure having a bottom and a side wall affording an inner chamber, the enclosure having an open top portion through which the electrical plug can be passed for positioning in the chamber, the bottom of the enclosure having an aperture for slidably receiving the conduit, said aperture being smaller in size than the electrical plug and the electrical device so that the conduit extends longitudinally through the aperture and enclosure to retain the enclosure on the conduit between the plug and the electrical device;

aperture means on opposite sides of the top portion of the enclosure; and a removable lock provided with a locking mechanism and a shackle, the shackle being selectively movable with respect to the locking mechanism between locked and unlocked positions, the shackle being of a size to pass through said aperture means to limit the size of said open top portion and to capture the electrical plug within the enclosure when the shackle is moved to locked position.

2. The apparatus of claim 1 in which the aperture means includes spaced pairs of apertures on opposite sides of the top portion of the enclosure, said apertures being positioned to receive the shackle in locked position.

3. The apparatus of claim 1 in which the enclosure is formed of a flexible material so that opposite sides of the top portion of the enclosure are moved toward each other when the shackle is in locked position.

4. An apparatus for preventing the unauthorized use of an electrical device, the electrical device including an electrical conduit attached at a device end to the electrical device, and at a remote end to an electrical plug, the apparatus comprising:

an enclosure having a bottom and a peripherally extending side wall affording an inner chamber, the enclosure having an open top portion through which the electrical plug can be passed for positioning in the chamber, the bottom of the enclosure having an aperture for slidably receiving the conduit, said aperture being smaller in size than the electrical plug and the electrical device so that the conduit extends longitudinally through the aperture and enclosure to retain the enclosure on the conduit between the device end and the remote end thereof;

aperture means on opposite sides of the enclosure; and a removable lock provided with a shackle selectively movable between the locked and unlocked position, the shackle being of a size to pass through the aperture means and to limit the size of the opening of the top portion of the enclosure so as to capture the electrical plug within the enclosure when the shackle is moved to the locked position.

5. The apparatus of claim 4 in which the aperture means includes spaced pairs of apertures, said apertures being positioned to receive the securing means.

6. The apparatus of claim 4 in which the enclosure is formed of a flexible material so that opposite sides of the top portion of the enclosure are moved toward each other when the shackle is in locked position.

* * * * *